US008202416B1

(12) United States Patent
Jones

(10) Patent No.: US 8,202,416 B1
(45) Date of Patent: Jun. 19, 2012

(54) POOL SKIMMER ENHANCEMENT SYSTEM

(75) Inventor: Ryan C. Jones, Dunedin, FL (US)

(73) Assignee: Crystal Blue Vortex, LLC, Belleair, FL (US)

( * ) Notice: Subject to any disclaimer, the term of this patent is extended or adjusted under 35 U.S.C. 154(b) by 294 days.

(21) Appl. No.: 12/586,511

(22) Filed: Sep. 23, 2009

(51) Int. Cl.
*E04H 4/12* (2006.01)

(52) U.S. Cl. ..... 210/167.18; 4/507

(58) Field of Classification Search ..... 210/167.1, 210/167.18; 4/507
See application file for complete search history.

(56) References Cited

U.S. PATENT DOCUMENTS

| | | | | |
|---|---|---|---|---|
| 4,818,389 | A * | 4/1989 | Tobias et al. | 210/167.12 |
| 5,510,020 | A * | 4/1996 | Gronlund | 210/167.18 |
| 2004/0238425 | A1* | 12/2004 | Hodak | 210/169 |
| 2005/0242014 | A1* | 11/2005 | Schneider | 210/169 |
| 2009/0120856 | A1* | 5/2009 | Meagher | 210/167.1 |

* cited by examiner

*Primary Examiner* — Fred Prince

(57) ABSTRACT

A face plate has a passageway positionable in a skimmer opening of a pool. An arcuate short diverter plate is coupled to a side edge of the face plate. An arcuate long diverter plate in a generally S-shaped configuration is coupled to a side edge of the face plate spaced from the short diverter plate. The diverter plates have closely spaced regions for forming a restricted flow path for water to be skimmed to increase water speed and skimming effectiveness. The long diverter plate has an arcuate region with a vertical axis of rotation co-extensive with an axis of a pool well.

6 Claims, 5 Drawing Sheets

FIG 1
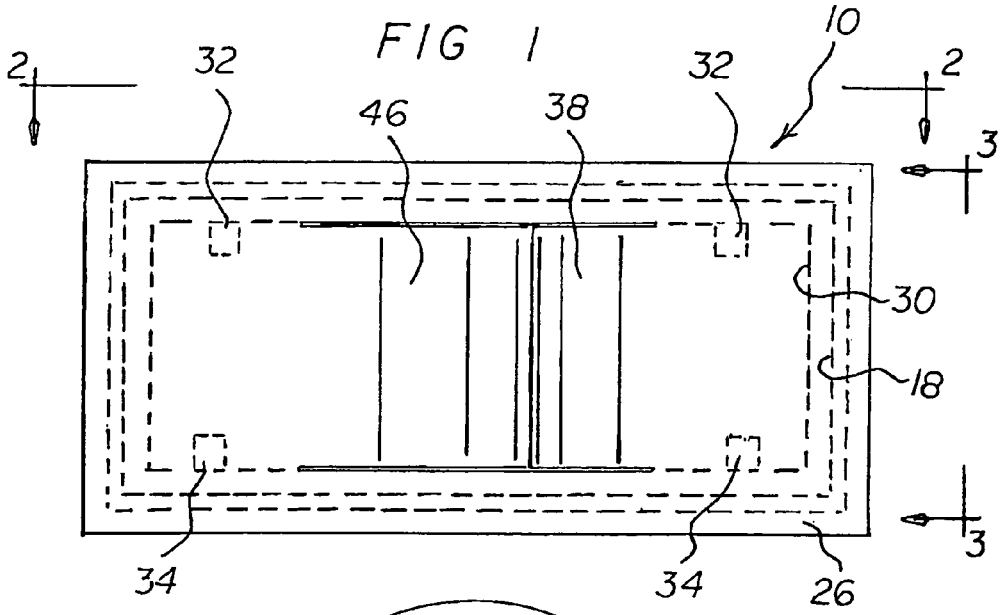
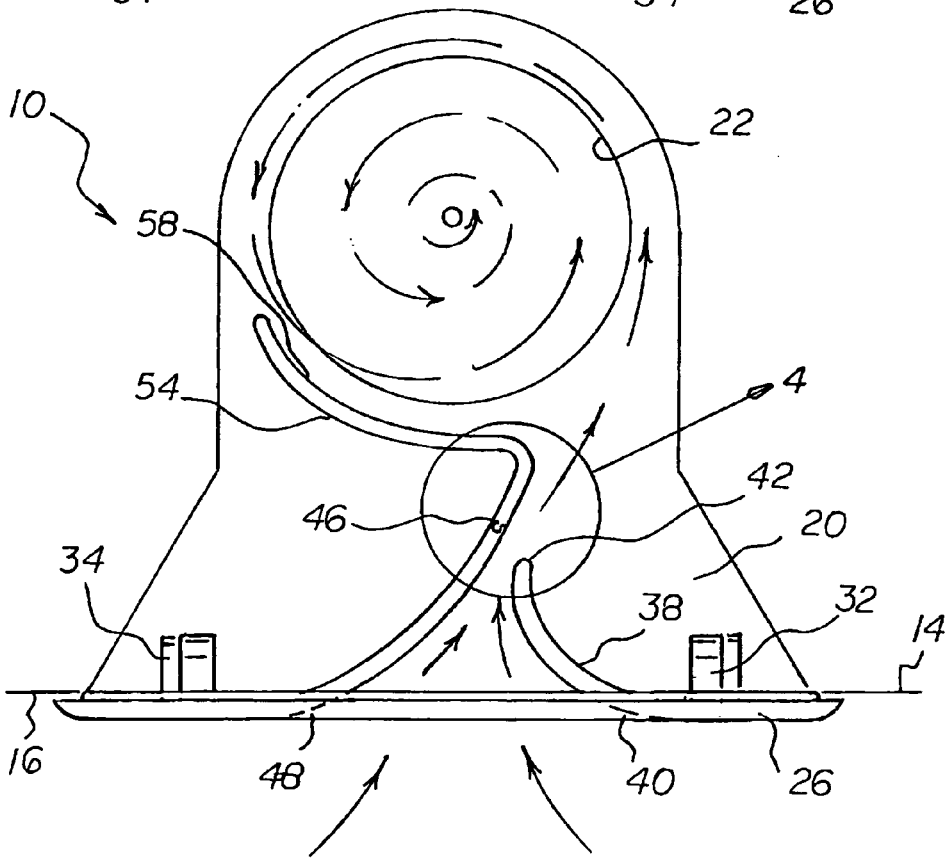
FIG 2

FIG 3
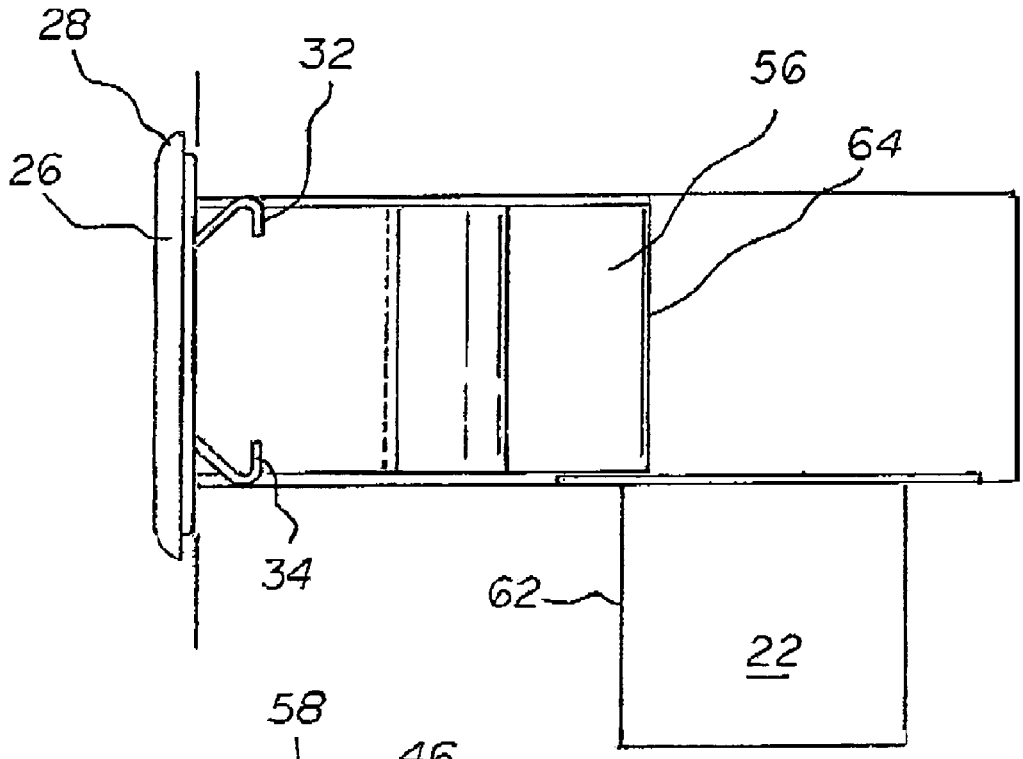
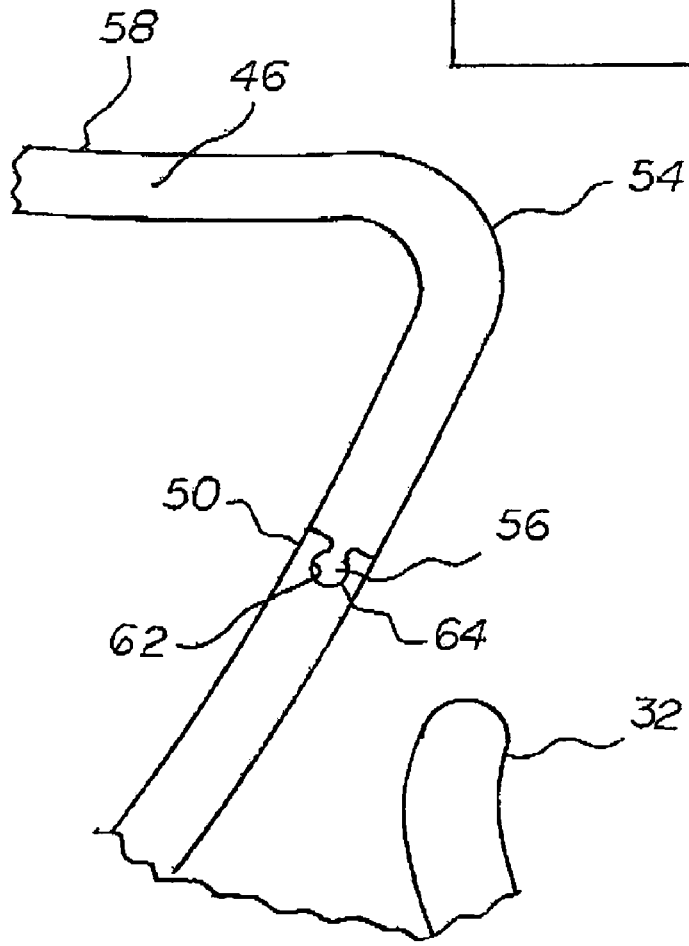
FIG 4

FIG 10
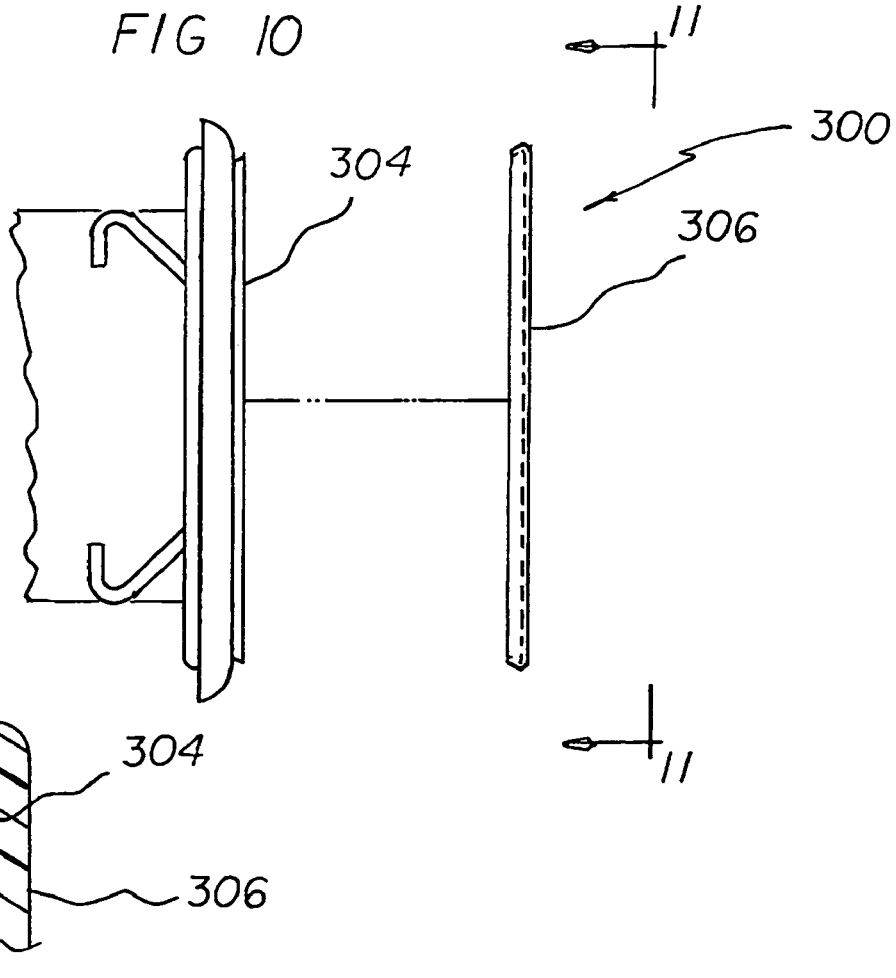
FIG 12
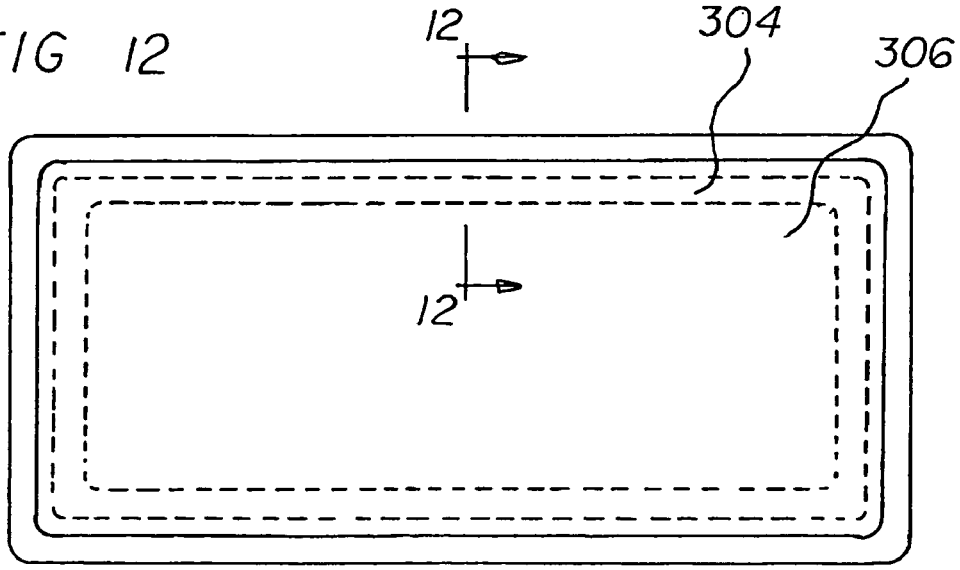
FIG 11

POOL SKIMMER ENHANCEMENT SYSTEM

BACKGROUND OF THE INVENTION

1. Field of the Invention

The present invention relates to a pool skimmer enhancement system and more particularly pertains to increasing the speed of water flowing through a skimmer thereby maximizing the skimming effectiveness of the system, the skimming being done in a safe, convenient, simple and economical manner.

2. Description of the Prior Art

The use of pool skimmer systems of known designs and configurations is known in the prior art. More specifically, pool skimmer systems of known designs and configurations previously devised and utilized for the purpose of improving the effectiveness of skimming are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a pool skimmer enhancement system that allows for increasing the speed of water flowing through a skimmer thereby maximizing the skimming effectiveness of the system, the skimming being done in a safe, convenient, simple and economical manner.

In this respect, the pool skimmer enhancement system according to the present invention substantially departs from the conventional concepts and designs of the prior art, and in doing so provides an apparatus primarily developed for the purpose of increasing the speed of water flowing through a skimmer thereby maximizing the skimming effectiveness of the system, the skimming being done in a safe, convenient, simple and economical manner.

Therefore, it can be appreciated that there exists a continuing need for a new and improved pool skimmer enhancement system which can be used for increasing the speed of water flowing through a skimmer thereby maximizing the skimming and filtration effectiveness of the system, the skimming being done in a safe, convenient, simple and economical manner. In this regard, the present invention substantially fulfills this need.

SUMMARY OF THE INVENTION

In view of the foregoing disadvantages inherent in the known types of pool skimmer systems of known designs and configurations now present in the prior art, the present invention provides an improved pool skimmer enhancement system. As such, the general purpose of the present invention, which will be described subsequently in greater detail, is to provide a new and improved pool skimmer enhancement system and method which has all the advantages of the prior art and none of the disadvantages.

To attain this, the present invention essentially comprises a swimming pool having a side wall with a rectangular opening at water level for the passage of water from the pool for the skimming of water and the removal of debris from the skimmed water. The opening has parallel upper and lower horizontal edges and parallel first and second side vertical edges. The swimming pool has a chamber located interiorly of and at a common elevation with the opening. The chamber has a cylindrical well with a vertical axis for drawing a vortex of water from the pool into a pump and for filtering out debris.

Next provided is a face plate. The face plate has a rectangular periphery with a size greater than the opening in the side wall. The face plate has a rectangular passageway of a size less than the opening in the side wall. The passageway has parallel upper and lower horizontal edges and parallel first and second side vertical edges. The face plate has an exterior surface extending into the pool and an interior surface facing the side wall. The interior surface has two upper spring clamps and two lower spring clamps. The spring clamps extend into the opening and contact the pool for the removable securement of the face plate to the pool.

Next, a first diverter plate is provided. The first diverter plate has an exterior edge attached to the first side edge of the face plate. The first diverter plate also has an interior edge within the chamber midway between the opening and the well. The first diverter plate is arcuate with a vertical axis of rotation interiorly of the first side edge of the face plate.

Next, a second diverter plate is provided. The second diverter plate has an exterior edge attached to the second side edge of the face plate. The second diverter plate also has an interior edge within the chamber midway between the opening and the well. The second diverter plate is arcuate with a vertical axis of rotation interiorly of the second side edge of the face plate. The interior edges of the first and second plate are spaced a distance of between 5 and 15 percent of the distance between the first and second side edges of the face plate for forming a restriction to increase water speed and skimming effectiveness.

Next, a third diverter plate is provided. The third diverter plate is in a generally S-shaped configuration with a primary section removably coupled to the interior edge of the second diverter plate. The third diverter plate has a secondary section with a vertical axis of rotation co-extensive with the axis of the well. The diverter plates all have a height essentially equal to the distance between the upper and lower edges of the passageway through the face plate.

Lastly, coupling components are provided. The coupling components include a linear recess along the interior edge of the second diverter plate and a linear projection along the primary section of the third diverter plate. The recess and projection are adapted to be coupled during operation and use. The recess and projection are adapted to be separated for packaging, storage and transportation purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pool skimmer enhancement system which has all of the advantages of the prior art pool skimmer systems of known designs and configurations and none of the disadvantages.

It is another object of the present invention to provide a new and improved pool skimmer enhancement system which may be easily and efficiently manufactured and marketed.

It is further object of the present invention to provide a new and improved pool skimmer enhancement system which is of durable and reliable constructions.

An even further object of the present invention is to provide a new and improved pool skimmer enhancement system which is susceptible of a low cost of manufacture with regard to both materials and labor, and which accordingly is then susceptible of low prices of sale to the consuming public, thereby making such pool skimmer enhancement system economically available to the buying public.

Even still another object of the present invention is to provide a pool skimmer enhancement system for increasing the speed of water flowing through a skimmer thereby maximizing the skimming and circulating effectiveness of the system, the skimming being done in a safe, convenient, simple and economical manner.

Lastly, it is an object of the present invention to provide a new and improved pool skimmer enhancement system has a face plate with a passageway positionable in a skimmer opening of a pool. An arcuate short diverter plate is coupled to a side edge of the face plate. An arcuate long diverter plate in a generally S-shaped configuration is coupled to a side edge of the face plate spaced from the short diverter plate. The diverter plates have closely spaced regions for forming a restricted flow path for water to be skimmed to increase water speed and skimming effectiveness. The long diverter plate has an arcuate region with a vertical axis of rotation co-extensive with an axis of a pool well.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a pool skimmer enhancement system constructed in accordance with the principles of the present invention.

FIG. 2 is a plan view of the system taken along line 2-2 of FIG. 1.

FIG. 3 is a side elevational view of the system taken along line 3-3 of FIG. 1.

FIG. 4 is an enlarged plan view of a portion of the system taken at circle 4 of FIG. 2.

FIG. 10 is a side elevational view of a portion of the system similar to FIG. 3 but with the portions separated prior to coupling and installation.

FIG. 11 is a front elevational view taken along line 11-11 of FIG. 10.

FIG. 12 is a cross sectional view taken along line 12-12 of FIG. 11.

The same reference numerals refer to the same parts throughout the various Figures.

DESCRIPTION OF THE PREFERRED EMBODIMENT

Figure 5:
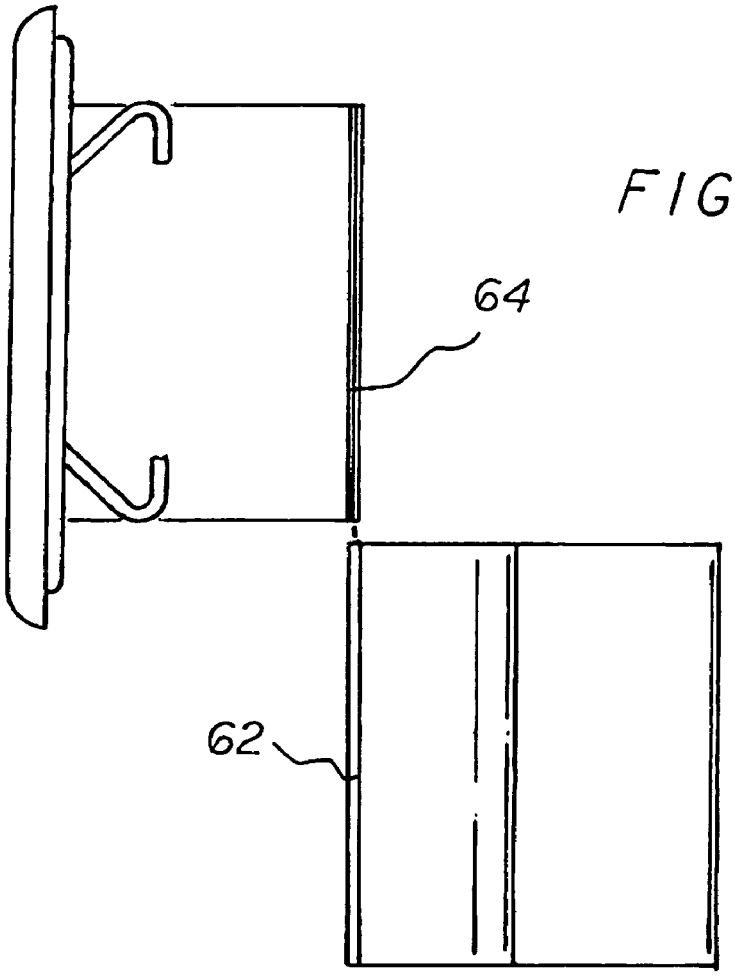
FIG. 5 is a side elevational view of a portion of the system similar to FIG. 3 but with the portions separated prior to coupling and installation.

With reference now to the drawings, and in particular to FIG. 1 thereof, the preferred embodiment of the new and improved pool skimmer enhancement system embodying the principles and concepts of the present invention and generally designated by the reference numeral 10 will be described.

The present invention, the pool skimmer enhancement system 10 is comprised of a plurality of components. Such components in their broadest context include a face plate and a long and short diverter plate. Such components are individually configured and correlated with respect to each other so as to attain the desired objective.

The pool skimmer enhancement system 10 of the present invention is for increasing the speed of water flowing through a skimmer thereby maximizing the skimming effectiveness of the system. The skimming is done in a safe, convenient, simple and economical manner. First provided is a swimming pool 14. The pool has a side wall 16 with a rectangular opening 18 at water level for the passage of water from the pool for the skimming of water and the removal of debris from the skimmed water. The opening has parallel upper and lower horizontal edges and parallel first and second side vertical edges. The swimming pool has a chamber 20 located interiorly of and at a common elevation with the opening. The chamber has a cylindrical well 22 with a vertical axis for drawing a vortex of water from the pool into a pump and for filtering out debris.

Next provided is a face plate 26. The face plate has a rectangular periphery 28 with a size greater than the opening in the side wall. The face plate has a rectangular passageway 30 of a size less than the opening in the side wall. The passageway has parallel upper and lower horizontal edges and parallel first and second side vertical edges. The face plate has an exterior surface extending into the pool and an interior surface facing the side wall. The interior surface has two upper spring clamps 32 and two lower spring clamps 34. The spring clamps extend into the opening and contact the pool for the removable securement of the face plate to the pool.

Next, a first diverter plate 38 is provided. The first diverter plate has an exterior edge 40 attached to the first side edge of the face plate. The first diverter plate also has an interior edge 42 within the chamber midway between the opening and the well. The first diverter plate is arcuate with a vertical axis of rotation interiorly of the first side edge of the face plate.

Next, a second diverter plate 46 is provided. The second diverter plate has an exterior edge 48 attached to the second side edge of the face plate. The second diverter plate also has an interior edge 50 within the chamber midway between the opening and the well. The second diverter plate is arcuate with a vertical axis of rotation interiorly of the second side edge of the face plate. The interior edges of the first and second plate are spaced a distance of between 5 and 15 percent of the distance between the first and second side edges of the face plate for redirecting the flow to increase water speed, suction, and skimming effectiveness.

Next, a third diverter plate 54 is provided. The third diverter plate is in a generally S-shaped configuration with a primary section 56 removably coupled to the interior edge of the second diverter plate. The third diverter plate has a secondary section 58 with a vertical axis of rotation co-extensive with the axis of the well. The diverter plates all have a height essentially equal to the distance between the upper and lower edges of the passageway through the face plate.

Lastly, coupling components are provided. The coupling components include a linear recess 62 along the interior edge of the second diverter plate and a linear projection 64 along the primary section of the third diverter plate. The recess and projection are adapted to be coupled during operation and use. The recess and projection are adapted to be separated for packaging, storage and transportation purposes.

Figure 6:
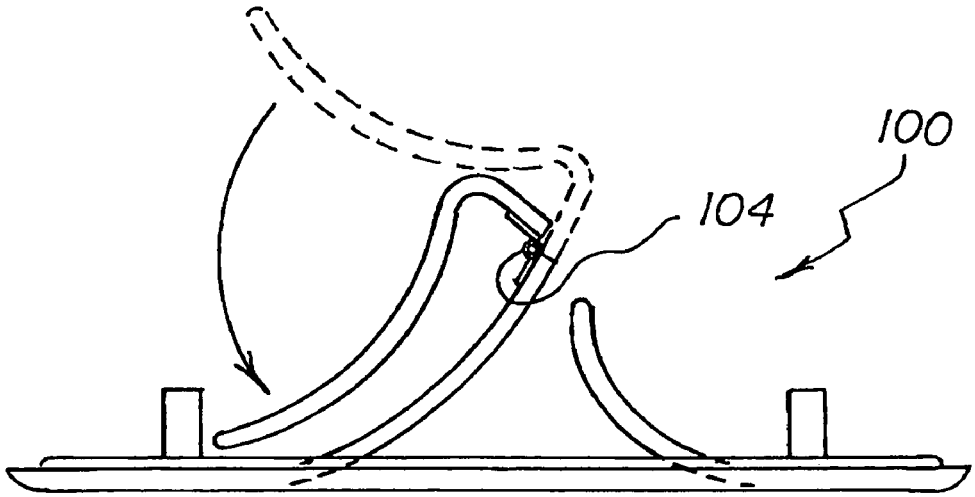
FIG. 6 is a plan view of a portion of the system similar to FIG. 2 but illustrating an alternate embodiment of the invention, portions of the system being folded prior to extending and installation.

An alternate embodiment of the system 100 is shown in FIG. 6. In this embodiment, the long diverter plate is formed of inner and outer sections. This embodiment further includes coupling components including a hinge 104 between the inner section and the outer section. The hinge is adapted to be folded out during operation and use. The hinge is also adapted to be folded in for packaging, storage and transportation purposes.

Figure 9:
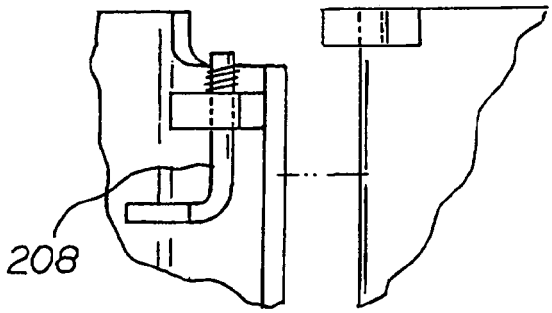
FIG. 9 is an enlarged side elevational view of a portion of the system taken at circle 9 of FIG. 8.
Figure 7:
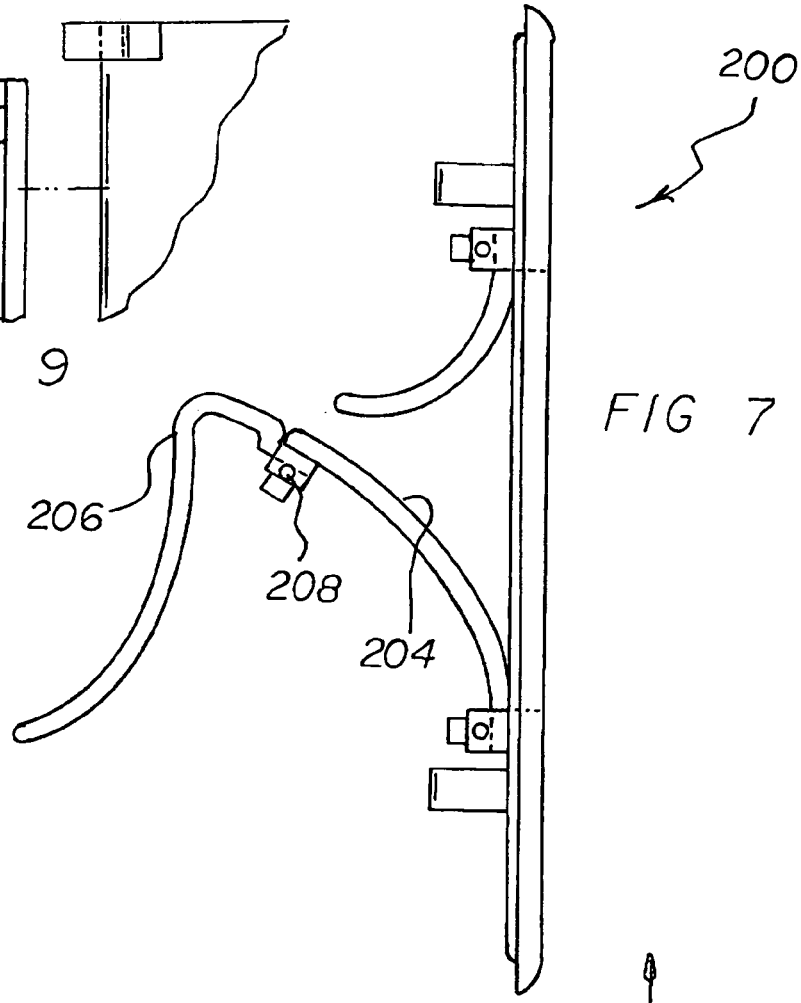
FIG. 7 is a plan view of a portion of the system similar to FIG. 2 but illustrating another alternate embodiment of the invention, portions of the system being folded prior to extending and installation.
Figure 8:
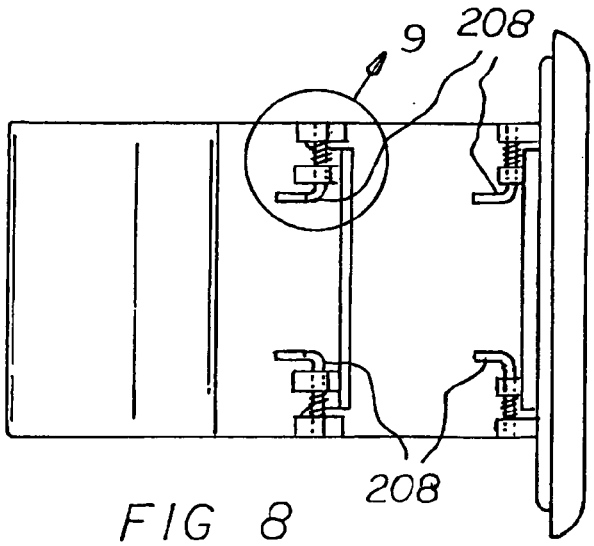
FIG. 8 is a side elevational view of the system taken along line 8-8 of FIG. 7.

An additional alternate embodiment of the system 200 is shown in FIGS. 7, 8 and 9. In this embodiment, the long diverter plate is formed of inner and outer sections 204, 206. This embodiment further includes coupling components. The coupling components include spring loaded fingers 208 between the inner section and the outer section. The fingers are adapted to be urged out during operation and use. The fingers are also adapted to be urged in for packaging, storage and transportation purposes. Spring loaded fingers are also located between the face plate and the diverter plates for further compacting of the system.

A final alternate embodiment of the system 300 is shown in FIGS. 10, 11 and 12. In this embodiment, the face plate has a peripheral flange 304. This embodiment further includes a cover 306 removably coupled to the flange.

The present invention includes a face plate with long and short diverter plates fabricated of a rigid, preferably plastic, material. The long diverter plate is formed of two sections, hinged or otherwise coupled, for being selectively configured in an operational orientation or in a storage orientation. The system is constructed larger or smaller to accommodate pools and skimmers of a plurality of different sites. The configuration and positioning of the diverter plates are such as to redirect the flow of water being skimmed and pumped through a filter. As a result, there is formed a vortex/whirlpool/cyclone/eddy in the skimmer by the plates to thereby build an increased suction in the main pool water in front of the skimmer. Skimming efficiency is thus increased.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pool skimmer enhancement system comprising:

a face plate having a passageway positionable in a skimmer opening of a pool;

an arcuate short diverter plate coupled to a side edge of the face plate; and an arcuate long diverter plate in a generally S-shaped configuration coupled to a side edge of the face plate spaced from the short diverter plate, the diverter plates having closely spaced regions for forming a restricted flow path for water to be skimmed, to increase water speed and skimming effectiveness, the long diverter plate having an arcuate region with a vertical axis of rotation co-extensive with an axis of a pool well.

2. The system as set forth in claim 1 wherein the long diverter plate is formed of inner and outer sections and further including coupling components including a linear recess along the inner section and a linear projection along the outer section, the recess and projection adapted to be coupled during operation and use, the recess and projection adapted to be separated for packaging, storage and transportation purposes.

3. The system as set forth in claim 1 wherein the long diverter plate is formed of inner and outer sections and further including coupling components including a hinge between the inner section and the outer section, the hinge adapted to be folded out during operation and use, the hinge adapted to be folded in for packaging, storage and transportation purposes.

4. The system as set forth in claim 1 wherein the long diverter plate is formed of inner and outer sections and further including coupling components including spring loaded fingers between the inner section and the outer section, the fingers adapted to be urged out during operation and use, the fingers adapted to be urged in for packaging, storage and transportation purposes.

5. The system as set forth in claim 1 wherein the face plate has a peripheral flange and further including a cover removably coupled to the flange.

6. A pool skimmer enhancement system for increasing the speed of water flowing through a skimmer thereby maximizing the skimming effectiveness of the system, the system comprising, in combination:

a swimming pool having a side wall with a rectangular opening at water level for the passage of water from the pool for the skimming of water and the removal of debris from the skimmed water, the opening having parallel upper and lower horizontal edges and parallel first and second side vertical edges, the pool having a chamber located interiorly of and at a common elevation with the opening, the chamber having a cylindrical well with a vertical axis for drawing a vortex of water from the pool into a pump and for filtering out debris;

a face plate having a rectangular periphery with a size greater than the opening in the side wall, the face plate having a rectangular passageway of a size less than the opening in the side wall, the passageway having parallel upper and lower horizontal edges and parallel first and second side vertical edges, the face plate having an exterior surface extending into the pool, the face plate having an interior surface facing the side wall, the interior surface having two upper spring clamps and two lower spring clamps, the spring clamps extending into the opening and contacting the pool for the removable securement of the face plate to the pool;

a first diverter plate having an exterior edge attached to the first side edge of the face plate and an interior edge within the chamber midway between the opening and the well, the first diverter plate being arcuate with a vertical axis of rotation interiorly of the first side edge of the face plate;

a second diverter plate having an exterior edge attached to the second side edge of the face plate and an interior edge within the chamber midway between the opening and the well, the second diverter plate being arcuate with a vertical axis of rotation interiorly of the second side edge of the face plate, the interior edges of the first and second plate being spaced a distance of between 5 and 15 percent of the distance between the first and second side edges of the face plate for forming a restriction to increase water speed and skimming effectiveness;

a third diverter plate in a generally S-shaped configuration with a primary section removably coupled to the interior edge of the second diverter plate, the third diverter plate having a secondary section with a vertical axis of rotation co-extensive with the axis of the well, the diverter plates all having a height essentially equal to the distance, between the upper and lower edges of the passageway through the face plate; and coupling components including a linear recess along the interior edge of the second diverter plate and a linear projection along the primary section of the third diverter plate, the recess and projection adapted to be coupled during operation and use, the recess and projection adapted to be separated for packaging, storage and transportation purposes.

* * * * *